US006186806B1

(12) United States Patent
Suzuki et al.

(10) Patent No.: US 6,186,806 B1
(45) Date of Patent: Feb. 13, 2001

(54) CONNECTOR AND ASSEMBLY JIG FOR ASSEMBLING THE CONNECTOR

(75) Inventors: Izumi Suzuki; Yukihiro Fukatsu, both of Yokkaichi (JP)

(73) Assignee: Sumitomo Wiring Systems, Ltd., Mie (JP)

( * ) Notice: Under 35 U.S.C. 154(b), the term of this patent shall be extended for 0 days.

(21) Appl. No.: 09/545,831

(22) Filed: Apr. 10, 2000

(30) Foreign Application Priority Data

| | | |
|---|---|---|
| Apr. 13, 1999 | (JP) | 11-105919 |
| Apr. 13, 1999 | (JP) | 11-105920 |
| Apr. 26, 1999 | (JP) | 11-118479 |
| May 31, 1999 | (JP) | 11-152645 |

(51) Int. Cl.[7] ..... H01R 29/00
(52) U.S. Cl. ..... 439/189; 439/589
(58) Field of Search ..... 439/189, 507, 439/509, 511, 587, 589, 595

(56) References Cited

U.S. PATENT DOCUMENTS

| | | | | |
|---|---|---|---|---|
| 5,201,667 | * | 4/1993 | Endo et al. | 439/189 |
| 5,769,650 | * | 8/1998 | Aoyama et al. | 439/189 |
| 5,788,519 | * | 8/1998 | Stern | 439/189 |

FOREIGN PATENT DOCUMENTS

| | | |
|---|---|---|
| 2-61082 U | 5/1990 | (JP) . |
| 4-42082 U | 4/1992 | (JP) . |
| 9-106847 | 4/1997 | (JP) . |
| 9-213436 | 8/1997 | (JP) . |

* cited by examiner

*Primary Examiner*—T. C. Patel
(74) *Attorney, Agent, or Firm*—Oliff & Berridge, PLC

(57) ABSTRACT

A connector includes a housing having a plurality of cavities, a plurality of resiliently deformable locking members, and a plurality of terminals. Each terminal is inserted in the respective cavity and has (a) a partially inserted position in which the terminal bears on the respective locking member to deform the locking member so that the locking member is elevated with respect to a peripheral surface of the housing, and (b) a fully inserted position in which the locking member snap-fits to the terminal thereby locking the terminal in the cavity. The connector further includes a bus bar holder having a sleeve and a plurality of bus bar tab pieces which are accommodated in the sleeve. The sleeve is push-fitted over the peripheral surface of the housing via a partially installed position, at which the tab pieces do not contact said terminals, to a fully installed position, at which the tab pieces contact said terminals. In this way, in the fully installed position, the bus bar holder is installed to the housing with the terminals electrically connected to each other. In addition, each locking member is adapted so that when the terminal is in the partially inserted position with the respective locking member elevated with respect to the peripheral surface of the housing and an attempt is made to push-fit the sleeve to the partially installed position, the sleeve bears on the locking member to prevent the sleeve arriving at the partially installed position. The connector also comprises a detent for detaining said bus bar holder at said partially installed position. An assembling jig is provided which, if the connector is not properly assembled at the partially installed position, will not accept the connector.

6 Claims, 10 Drawing Sheets

CONNECTOR AND ASSEMBLY JIG FOR ASSEMBLING THE CONNECTOR

BACKGROUND OF THE INVENTION

1. Field of Invention

The present invention relates to a connector, particularly a connector for use in the wiring of a vehicle such as an automobile, and a jig for assembling the connector.

2. Description of Related Art

A connector which is capable of detecting the incomplete insertion of a terminal is disclosed in Japanese Patent Application Laid-Open No. 9-106847. In the connector, cavities are formed in a housing. A lance for preventing removal of a terminal is formed in each cavity such that the locking lance confronts an outer surface of the housing, and a retainer is installed on the outer surface of the housing. In the case where every terminal has been inserted into the normal position of each cavity, the locking lances are flush with the outer surface of the housing. In this case, the retainer can be installed on the housing without the retainer interfering with the locking lances. On the other hand, in the case where any of the terminals has not been inserted into the normal position of each cavity, the terminal bears on the locking lance and the locking lance is projected outwardly from the outer surface of the housing. In this case, when the retainer is installed on the housing it collides with the locking lance. Thus, the installation of the retainer on the housing is suspended. In this manner, it is possible to detect whether the terminal has been properly inserted by whether the retainer can be installed on the housing.

However, there remains a problem when installation of the retainer is performed at the same time that a bus bar is connected to the terminals. During installation of the bus bar, the bus bar engages the terminals. As a result, frictional resistance is generated, and the operator performing the installation may mistakenly believe that installation resistance has been caused not by the collision between the retainer and the locking lance but by the friction between the bus bar and the terminals. In this case the operator may continue with the installation of the bus bar and the retainer on the housing, and consequently the locking lance may be broken. Alternatively, the operator may mistakenly believe that installation resistance has been generated not by friction between the bus bar and the terminal fitting but by the collision between the retainer and the locking lance and may unnecessarily check the insertion state of the terminal.

SUMMARY OF THE INVENTION

Therefore, it is an object of the present invention to reliably detect the incomplete insertion of a terminal.

According to a first aspect of the present invention there is provided a connector including a housing having a plurality of cavities, a plurality of resiliently deformable locking members, and a plurality of terminals. Each terminal is inserted in the respective cavity and has (a) a partially inserted position in which the terminal bears on the respective locking member to deform the locking member so that the locking member is raised with respect to a peripheral surface of the housing and (b) a fully inserted position in which the locking member snap-fits to the terminal thereby locking the terminal in the cavity. The connector further includes a bus bar holder having a sleeve and a plurality of bus bar tab pieces which are accommodated in the sleeve. The sleeve is push-fitted over the peripheral surface of the housing via a partially installed position, at which the tab pieces do not contact the terminals, to a fully installed position, at which the tab pieces contact the terminals. In this way, in the fully installed position, the bus bar holder is installed to the housing with the terminals electrically connected to each other.

In addition, each locking member is adapted so that when a terminal is in its partially inserted position with the respective locking member elevated from the peripheral surface of the housing and an attempt is made to push-fit the sleeve to the partially installed position, the sleeve bears on the locking member to prevent the sleeve from arriving at the partially installed position. The connector also includes a detent that detains the bus bar holder at the partially installed position.

During installation of the bus bar holder on the housing up to and including when the holder reaches the partially installed position, the bus bar holder is not subjected to any resistance that may be generated by the contact between the bus bar tab pieces and the terminals. However, after the bus bar holder passes the partially installed position, the tab pieces start to contact the terminals. Accordingly, it is possible to discriminate between the installation resistance on the bus bar holder due to the collision between a locking member and the sleeve, and the installation resistance that is generated due to collision or friction between the terminals and the tab pieces, because the former installation resistance would be felt before the bus bar holder reached the partially installed position. In this manner, it is possible reliably to detect the insertion state of the terminals.

In a second aspect of the present invention there is provided an assembly jig for setting thereon the connector of the first aspect of the invention and for assembling the connector by push-fitting the sleeve of the connector from the partially installed position to the fully installed position. The jig is sized so that when the sleeve of the connector is prevented from arriving at the partially installed position the connector is prevented from being set on the jig. On the other hand, when the sleeve of the connector is at the partially installed position the connector, is settable on the jig.

If the bus bar holder is prevented from arriving at the partially installed position by a collision between the sleeve and a locking member, which is in turn caused by the corresponding terminal having not been fully inserted, it is impossible to set the connector on the assembly jig. This is so even if the operator has not previously detected the incomplete insertion of the terminal. In this manner, it may be reliably detected that one or more of the terminals is in an incomplete insertion state.

BRIEF DESCRIPTION OF THE DRAWINGS

An embodiment of the invention will now be described by way of non-limitative example with reference to the accompanying drawings, in which.

DETAILED DESCRIPTION OF PREFERRED EMBODIMENTS

Figure 1:
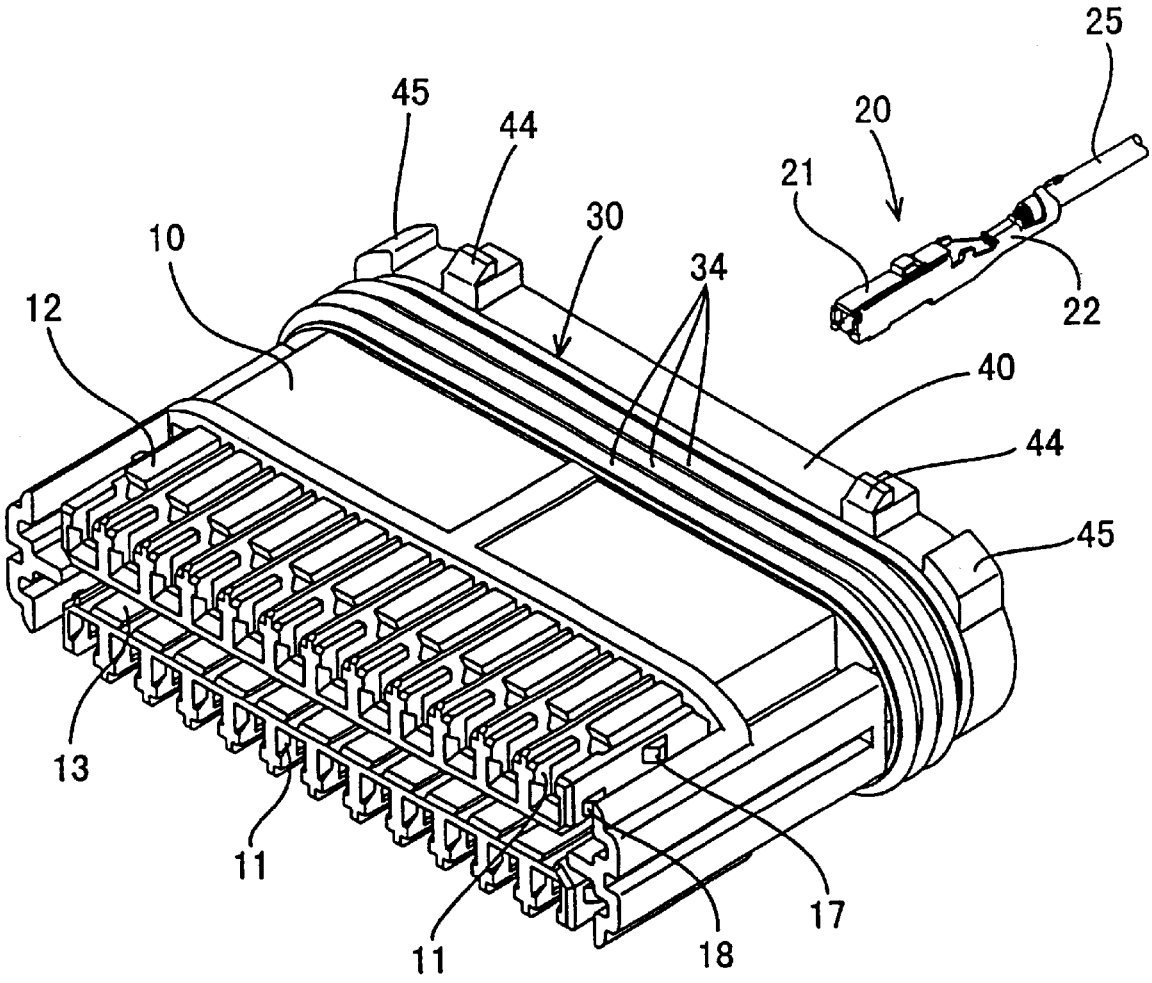
FIG. 1 is a perspective view of the housing, sealing member and seal holder of a connector embodying the invention.

A connector embodying the present invention is shown in FIGS. 1 to 10. The connector electrically connects a plurality of terminals 20 in a predetermined connection pattern with a bus bar 55 and has a housing 10, a plurality of the terminals 20, a sealing member 30, a seal holder 40, two bus bar units 50, and a cap 60.

The housing 10 is made of a synthetic resinous material. As shown in FIG. 1, the housing 10 has cavities 11 arranged in upper and lower rows and extending through the housing 10 in a front-to-rear direction. In each of the upper and lower rows, the cavities 11 may be arranged widthwise at regular intervals. The front half region of the upper-row cavities 11 and the lower-row cavities 11 are open at the upper and lower surfaces of the housing 10, respectively. In each open portion, locking members, such as locking lances 12, project forward in a cantilever manner. Between the upper and lower rows of the cavities 11 there is formed a wide recess 13 for allowing the peripheral walls of the bus bar units 50 to penetrate. An upper surface wall and a lower surface wall of the recess 13 are partly cut away to allow communication with the cavities 11.

Figure 6:
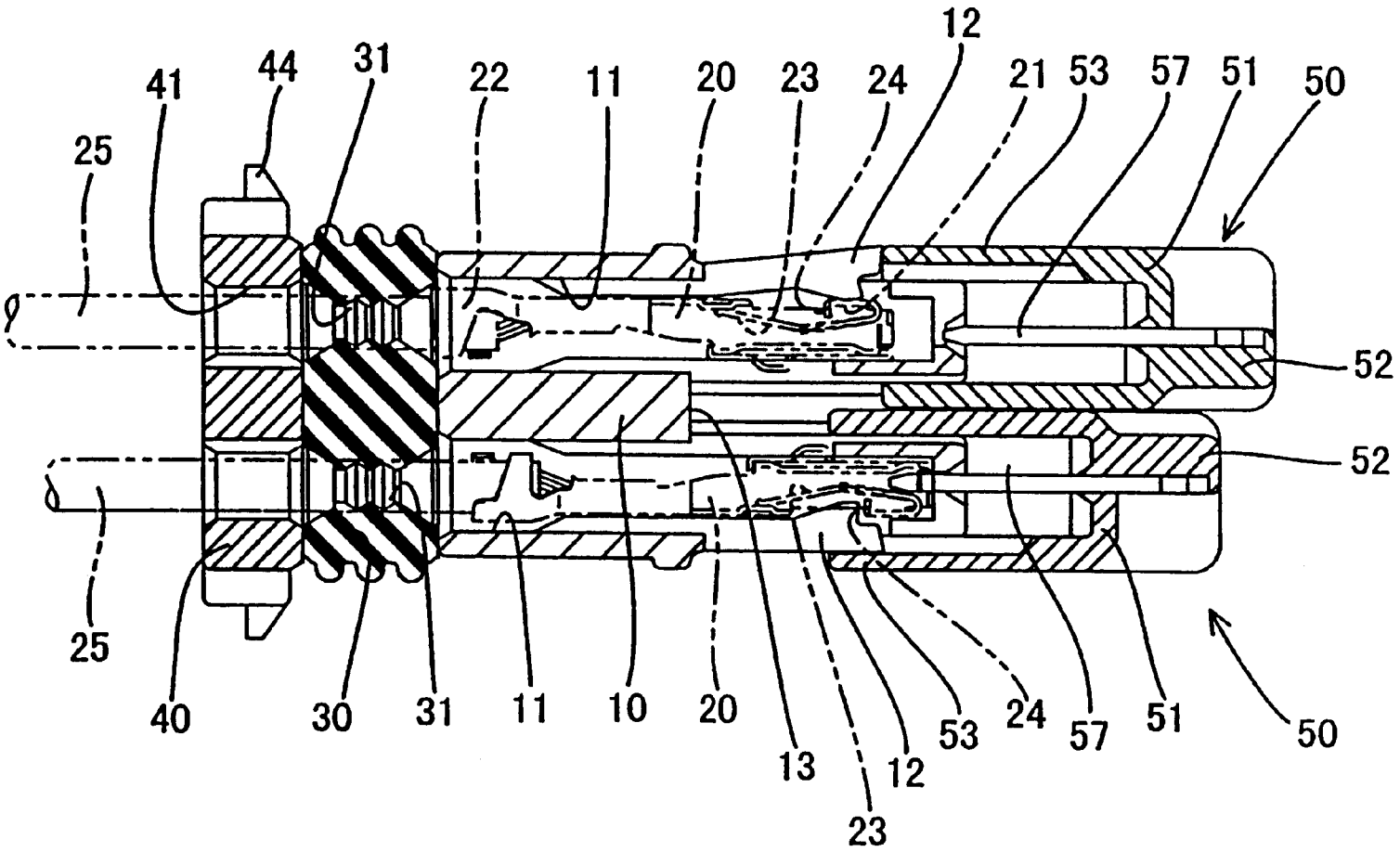
FIG. 6 is a sectional view on line 6—6 of FIG. 4 including terminals in the connector cavities (in broken lines), a lower bus bar unit fully installed, and an upper bus bar unit bearing on a locking lance.

The locking lances 12 retain and prevent the removal of the terminals 20 inserted into the cavity 11. In cooperation with a cylindrical portion 53 of the bus bar unit 50, it is also used for detecting the degree of insertion of the terminal 20. As shown in FIG. 6, each locking lance 12 can be outwardly elastically displaced relative to an outer surface of the housing 10. Before each terminal 20 is inserted into each cavity 11 or when the terminals 20 are fully inserted therein, the locking lances 12 are undeformed, and an outer surface of the locking lance is flush with the outer surface of the housing 10. In this state, a removal prevention projection formed at a front end of the locking lance 12 is engaged in a locking hole 24 of the terminal 20 (see lower bus bar unit of FIG. 6), thus preventing removal of the terminals 20. However, when any terminal 20 is not fully inserted, the removal prevention projection interferes with the outer surface of a mating portion 21 of the terminals 20 that are not fully inserted. As a result, the corresponding locking lances 12 are elastically displaced outward such that the outer surface is located outwardly from the outer surface of the housing 10 (see upper bus bar unit of FIG. 6). Therefore, when each bus bar unit 50 is installed on the housing 10, the cylindrical portion 53 of the bus bar unit 50 collides with the front end of the locking lances 12. This prevents the bus bar from being completely installed.

Each terminal 20 is made of a metal plate material punched into a predetermined configuration. As shown in FIG. 1 and FIG. 6, the front half part of each terminal 20 may be formed as a square pillar-shaped mating portion 21 that is open forward and rearward. The rear half of the terminal 20 is formed as an electric wire connection portion 22 that may be crimped to the core of an electric wire 25.

As shown in FIGS. 6–10, a resilient contact piece 23 that contacts a connection piece 57 of the bus bar 55, described in detail below, is formed inside the mating portion 21. The locking hole 24 with which the locking lance 12 of the housing 10 engages is formed on a peripheral wall of the mating portion 21. Each terminal 20 is inserted into a respective cavity 11 of the housing 10 by passing it through the seal member 30 and the seal holder 40 installed on the housing 10 from the rear of the housing 10. Immediately before the terminal 20 reaches its fully inserted position, the locking lance 12 interferes with the peripheral surface of the mating portion 21. Therefore, the locking lance 12 flexes elastically outward from the housing 10. When the terminal 20 reaches the fully inserted position, the locking lance 12 is elastically restored to its original state and is engaged in the locking hole 24, thus preventing the terminal 20 from being removed from the cavity 11. The orientation of the terminals 20 in the upper row of cavities 11 is preferably reversed relative to that of the terminals in the lower cavity row.

Figure 4:
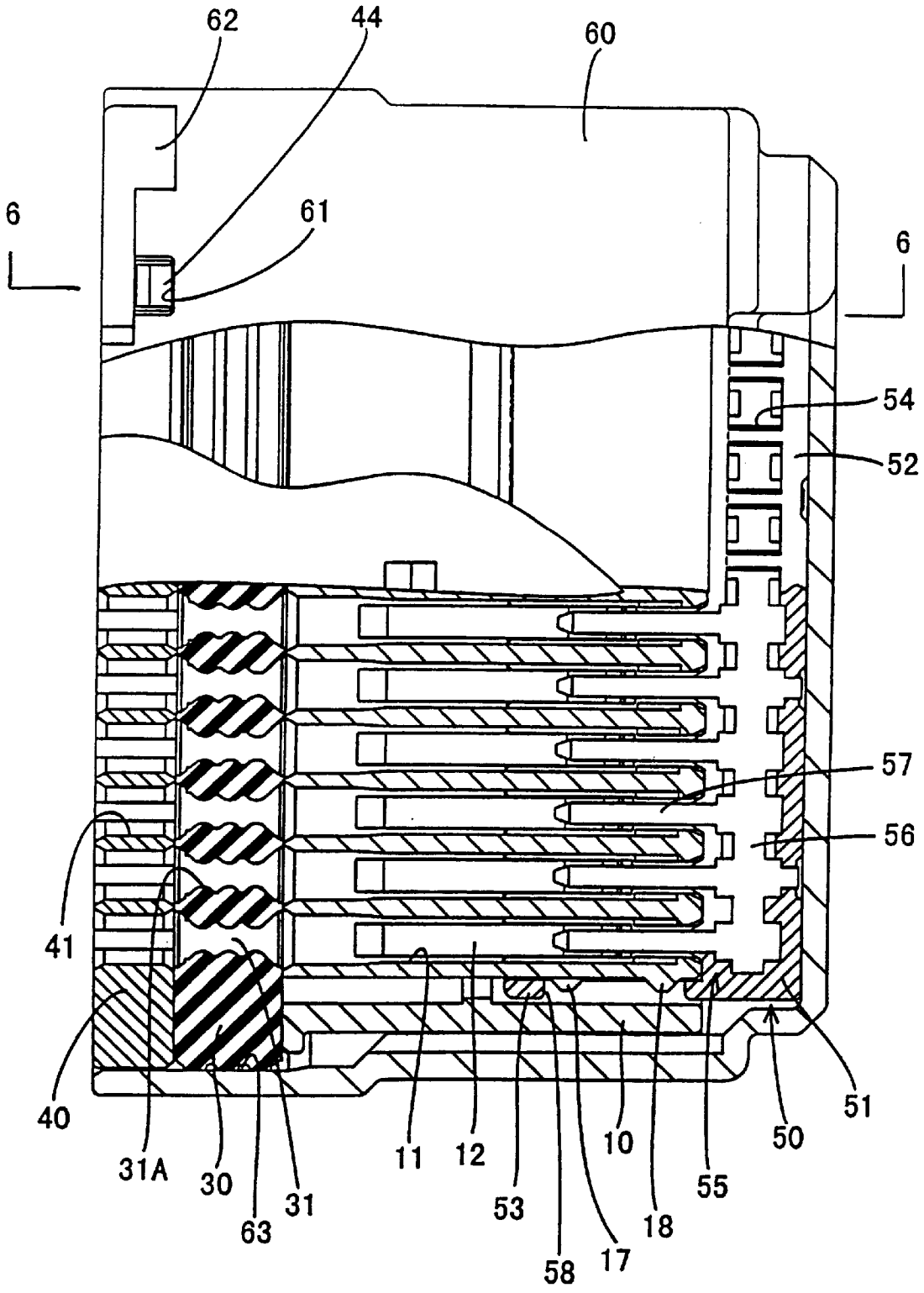
FIG. 4 is a partly cut-away plan view of the connector in an assembled state.
Figure 5:
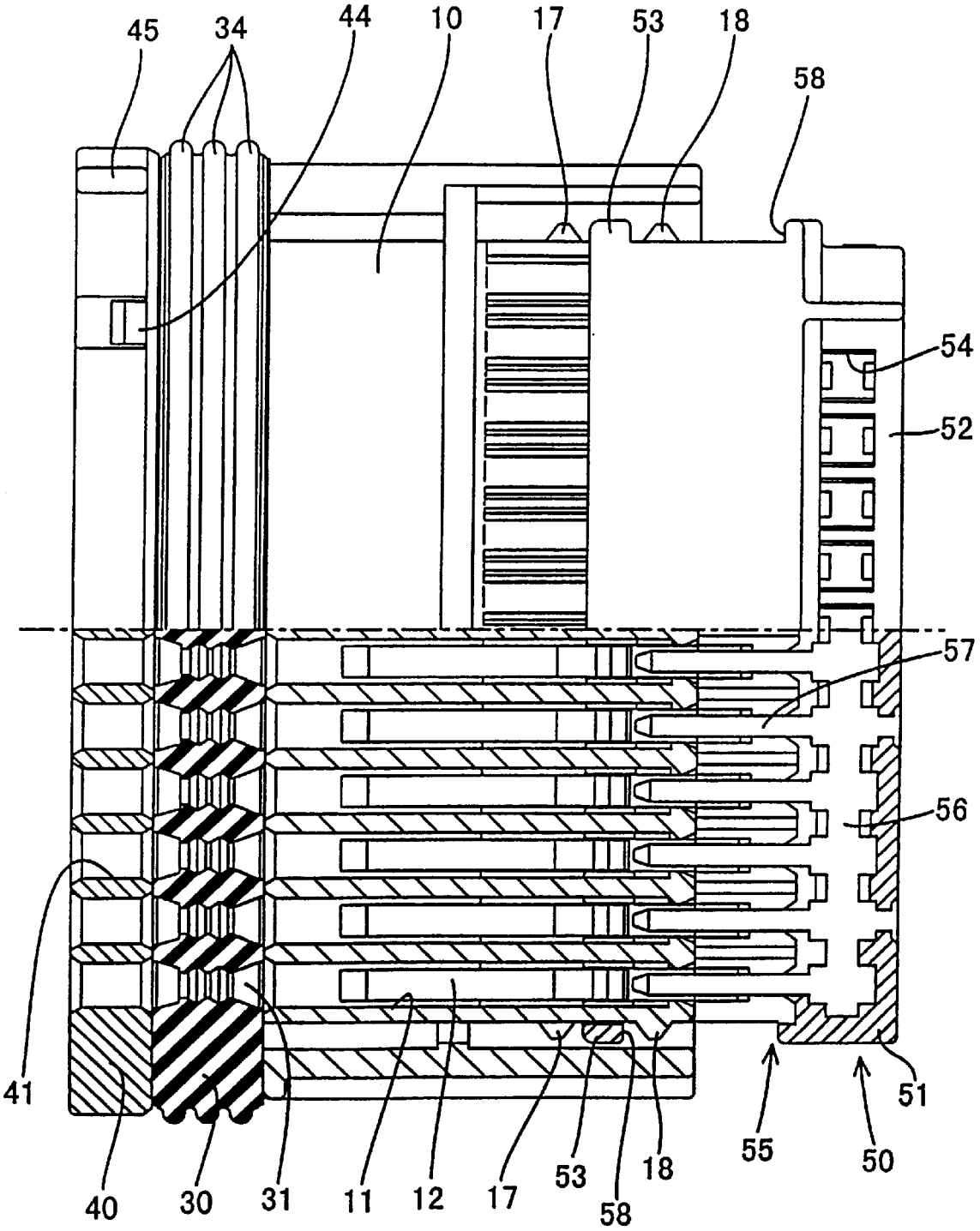
FIG. 5 is a partly cut-away plan view of the connector in which a bus bar unit is positioned at a temporary locking position.

The sealing member 30 is made of rubber, oval-shaped, and thick. As shown in FIG. 1, the sealing member 30 is installed on the housing 10 and is sandwiched between the rear end surface of the housing 10 and the front end surface of the seal holder 40. As shown in FIG. 4, a plurality of sealing holes 31 that are open at the front and rear surfaces of the sealing member 30 are formed coincident with the cavities 11 of the housing 10. Each sealing hole 31 may be circular, for example. A lip portion 31A of corrugated shape has, for example, three convexities which are circumferentially formed on the inner peripheral surface of each sealing hole 31 as shown in FIGS. 4–5. The inner diameter of the lip portion 34 is smaller than the outer diameter of the coating of the wire 25. When a wire 25 is in a sealing hole 31, as shown in FIG. 6, the lip portion contacts the peripheral surface of the wire 25 elastically, thus sealing around the wire 25.

The peripheral edge of the sealing member 30 is formed as a corrugated sealing edge. The lip portion 34 also has, for example, three convexities approximately semi-circular in section extending circumferentially around the sealing member 30. The lip portion 34 contacts the inner peripheral surface of the cap 60 elastically, thus sealing between the sealing member 30 and the cap 60.

The seal holder 40 is made of a relatively rigid synthetic resin material. Similarly to the sealing member 30, the seal holder 40 may be oval-shaped. The lip portion 34 formed on the periphery of the sealing member 30 is slightly larger than the periphery of the seal holder 40. A plurality of terminal insertion openings 41 shown in FIGS. 4–6 extend between the front and rear end surfaces of the seal holder 40 in correspondence to the cavities 11 and the sealing holes 31. Each terminal 20 is inserted into a respective cavity 11 through a respective terminal insertion opening 41.

Two locking projections 44 are formed at each end of upper and lower flat peripheral surfaces of the seal holder 40. The locking projections 44 engage the cap 60, thus hindering the cap 60 from being easily removed from the housing 10, the sealing member 30 and the seal holder 40. An index projection 45 is formed in each circular arc-shaped region located at right and left ends of the peripheral surface of the seal holder 40. Each of a pair of the index projections 45 may be formed such that the inward side thereof is on a level higher than that of the outward side thereof. The index projections 45 serve as indexes for checking the upper and lower sides of the housing 10 when the terminals 20 are inserted into the cavities 11.

Figure 2:
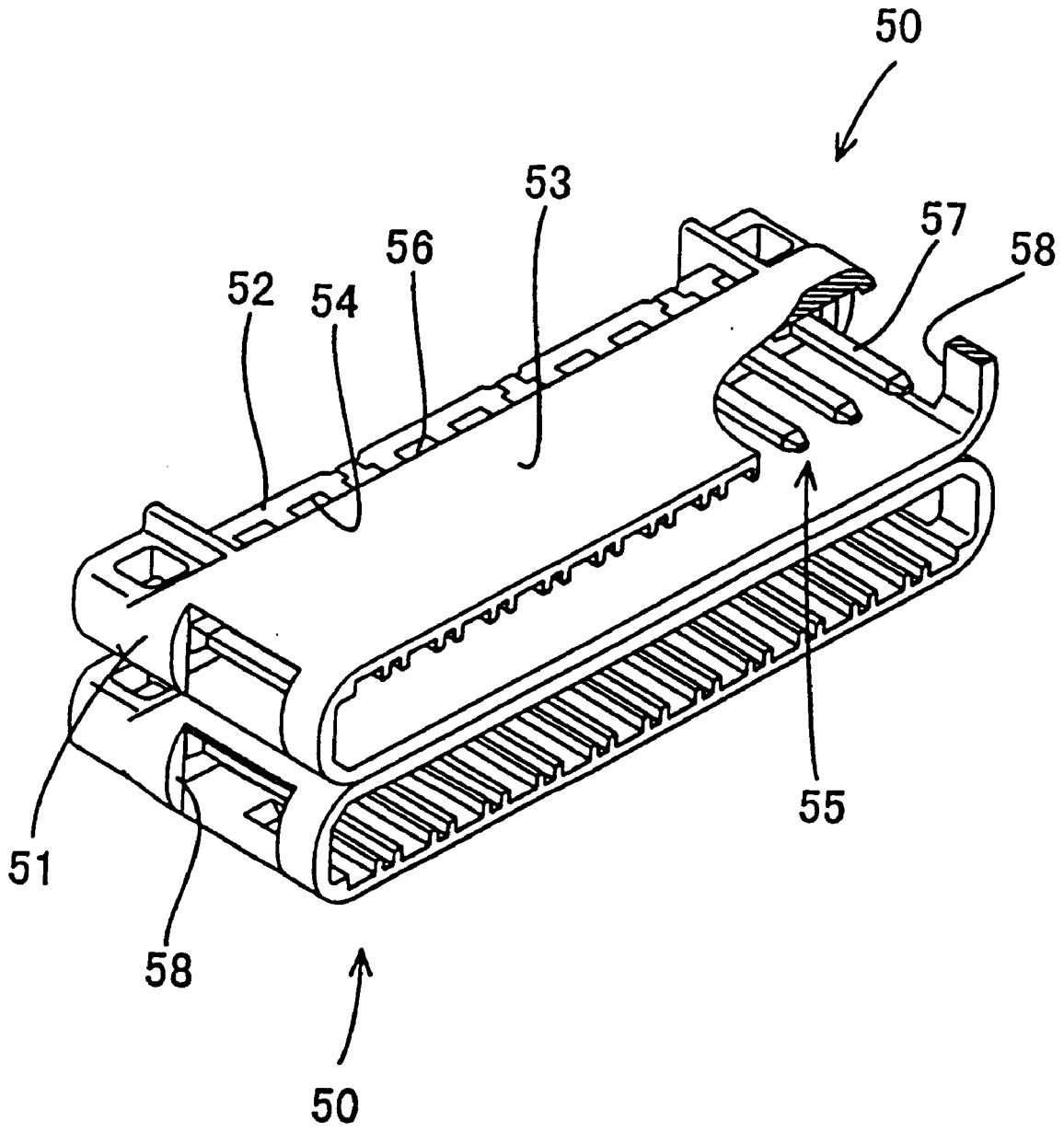
FIG. 2 is a partly cut-away perspective view of a bus bar unit of the connector of FIG. 1.

As shown in FIG. 2, the bus bar unit 50 is composed of a holding member 51 made of a relatively rigid synthetic resin material and a metal bus bar 55 integrated with the holding member 51 by insert molding. The holding member 51 has a wide sheet-shaped holding portion 52 and a flat cylindrical portion 53 projecting rearward (direction toward the housing 10) from the sheet-shaped holding portion 52. The bus bar 55 includes a plurality of connection pieces 57 projecting in parallel with each other in the shape of a cantilever from an edge of a belt-shaped carrier 56. The bus bar 55 is held with the carrier 56 disposed along the sheet-shaped holding portion 52 and with connection pieces 57 facing the cylindrical portion 53. Punched holes 54 are formed on the sheet-shaped holding portion 52 in correspondence to the gaps between adjacent connection pieces 57 projecting from the carrier 56. In the process of producing the bus bar unit 50, a portion of a carrier 56 facing each punched hole 54 is punched with a punch and die in correspondence to a predetermined connection pattern. As a result, the carrier 56 is divided (not shown) into a plurality of bus bars 55. One bus bar 55 has at least three connection pieces 57. A plurality of the terminals 20 are connected by each bus bar 55 through the connection pieces 57.

Each bus bar unit 50 is installed on the housing 10 in a direction forward therefrom such that the cylindrical portion 53 covers the upper-row cavities 11 or the lower-row cavities 11. When the bus bar unit 50 has been installed on the housing 10, the connection pieces 57 are connected with the terminals 20. Connection patterns can be discriminated from each other by, for example, changing the color of the holding member 51 of the bus bar unit 50. The upper part of the holding member 51 and the lower part thereof are not symmetrical. Thus, the bus bar unit 50 can be installed on the housing 10 in a correct direction, and a group of the terminals 20 can be connected in a correct pattern by checking colors and directions of the holding members 51.

Figure 3:
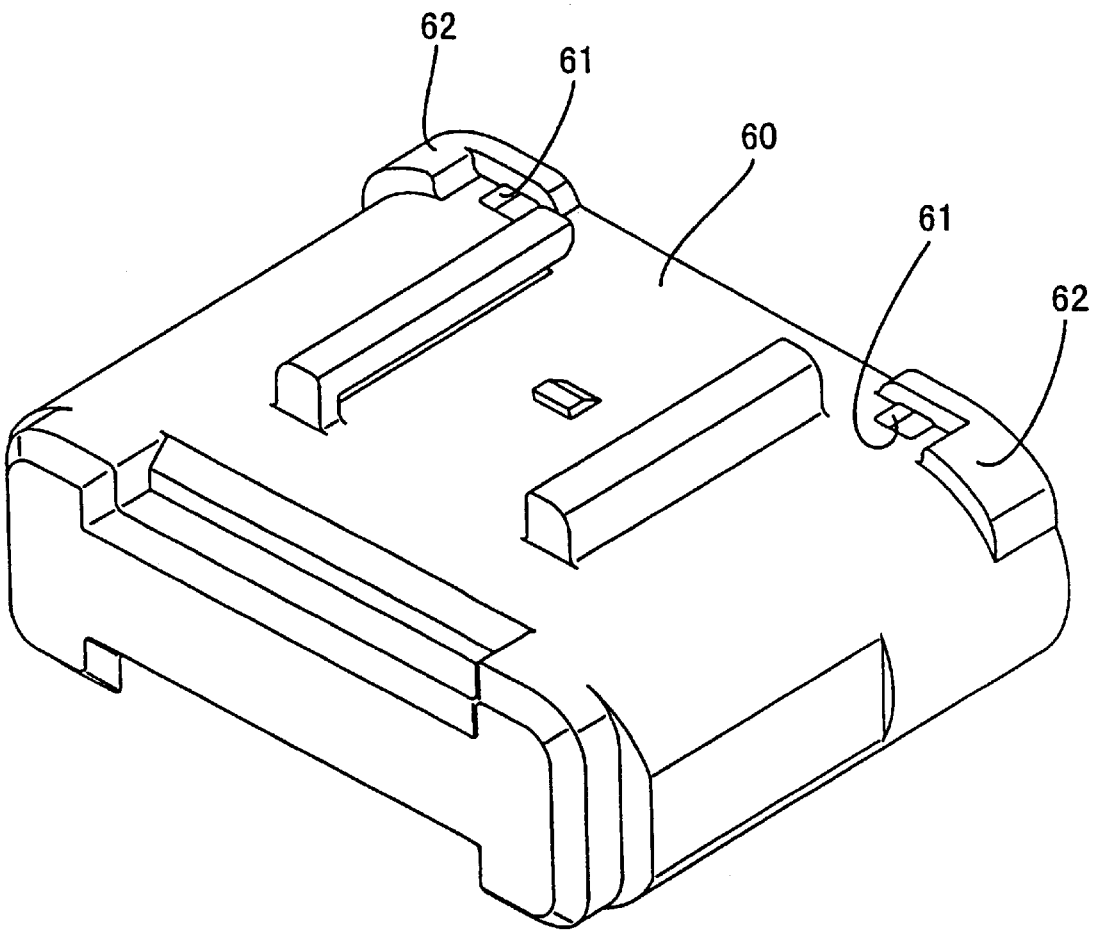
FIG. 3 is a perspective view of a cap for the connector shown in FIG. 1.
Figure 10:
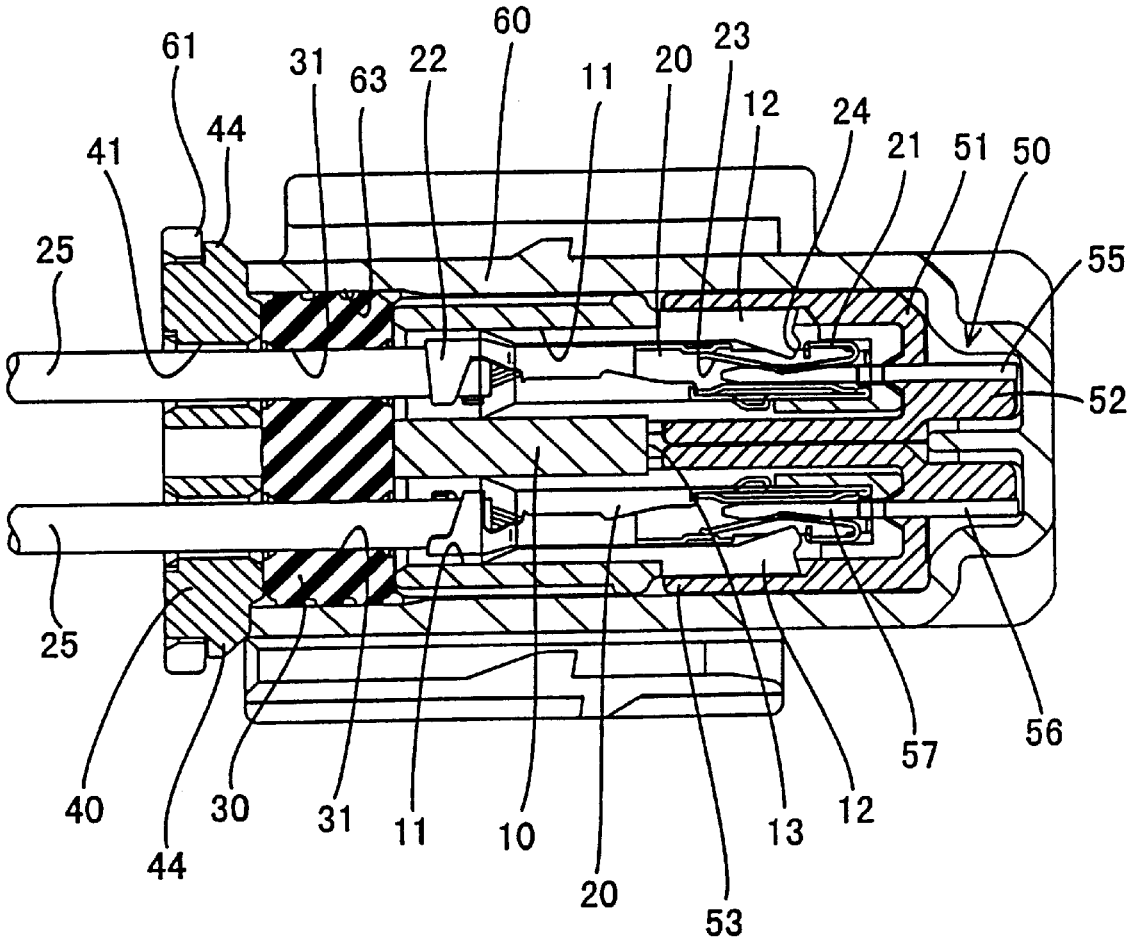
FIG. 10 is the same section view as FIG. 6 but with both bus bar units fully installed.

The cap 60 is made of a relatively rigid synthetic resin material. As shown in FIG. 3, the cap 60 is oval-shaped in a front view and has a closed bottom. Locking holes 61 to which the locking projections 44 of the seal holder 40 lock are formed at the edge of the open mouth of the cap 60. The cap 60 is locked in the installed state by the engagement between the locking projections 44 and the locking holes 61. Relief portions 62 projecting outwardly are formed on the edge of an opening of the cap 60 to prevent the cap 60 from interfering with the index projections 45 of the seal holder 40. The region of the inner peripheral surface of the cap 60 near the edge of its opening is formed as a sealing surface 63 with which the lip portion 34 formed on the peripheral edge of the sealing member 30 contacts elastically as shown in FIG. 10.

Guide grooves 58 shown in FIG. 2, which are part of a temporary locking mechanism or detent, extend in a front to rear direction at the right and left-hand sides of the cylindrical portion 53 of each bus bar unit 50. Front and rear locking projections 17 and 18, which are also part of the temporary locking mechanism or detent, corresponding to each guide groove 58 are formed on the housing 10. Each bus bar unit 50 is held at a temporary locking position whereby a rear end portion of the cylindrical portion 53 is between the locking projections 17 and 18. The rear end portion is defined by the rear edge of the cylindrical portion 53 and the rear end of the guide groove 58 (see FIG. 5). Each bus bar unit 50 is held at a fully installed position by locking the front end of the guide groove 58 and the rear end thereof to the locking projections 17 and 18, respectively, with the front and rear ends of the guide groove 58 sandwiching the locking projections 17 and 18 therebetween (see FIG. 4). When the bus bar units 50 are held at the fully installed position, the terminals 20 are electrically connected by the bus bars 55. As described above, during the installation of each bus bar unit 50 on the housing 10, the bus bar units 50 are held at the temporary locking position (see lower bus bar unit of FIG. 6 and FIG. 7) which is located forward from the fully installed position (see FIGS. 8 and 10) where the terminals are electrically connected. The temporary locking position is located rearwardly from a collision position at which the locking lances 12 would collide with the respective bus bar unit 50 if the locking lances 12 were outwardly displaced from the outer surface of the housing 10 due to an incomplete terminal insertion (see upper step of FIG. 6). In other words, on installation each bus bar unit 50 must pass the collision position before it arrives at the temporary locking position. Over the distance between an installation start position of the bus bar unit 50 and the temporary locking position, through the collision position between the locking lances 12 and the bus bar unit 50, the tab pieces 57 are not in contact with the terminals 20.

Figure 7:
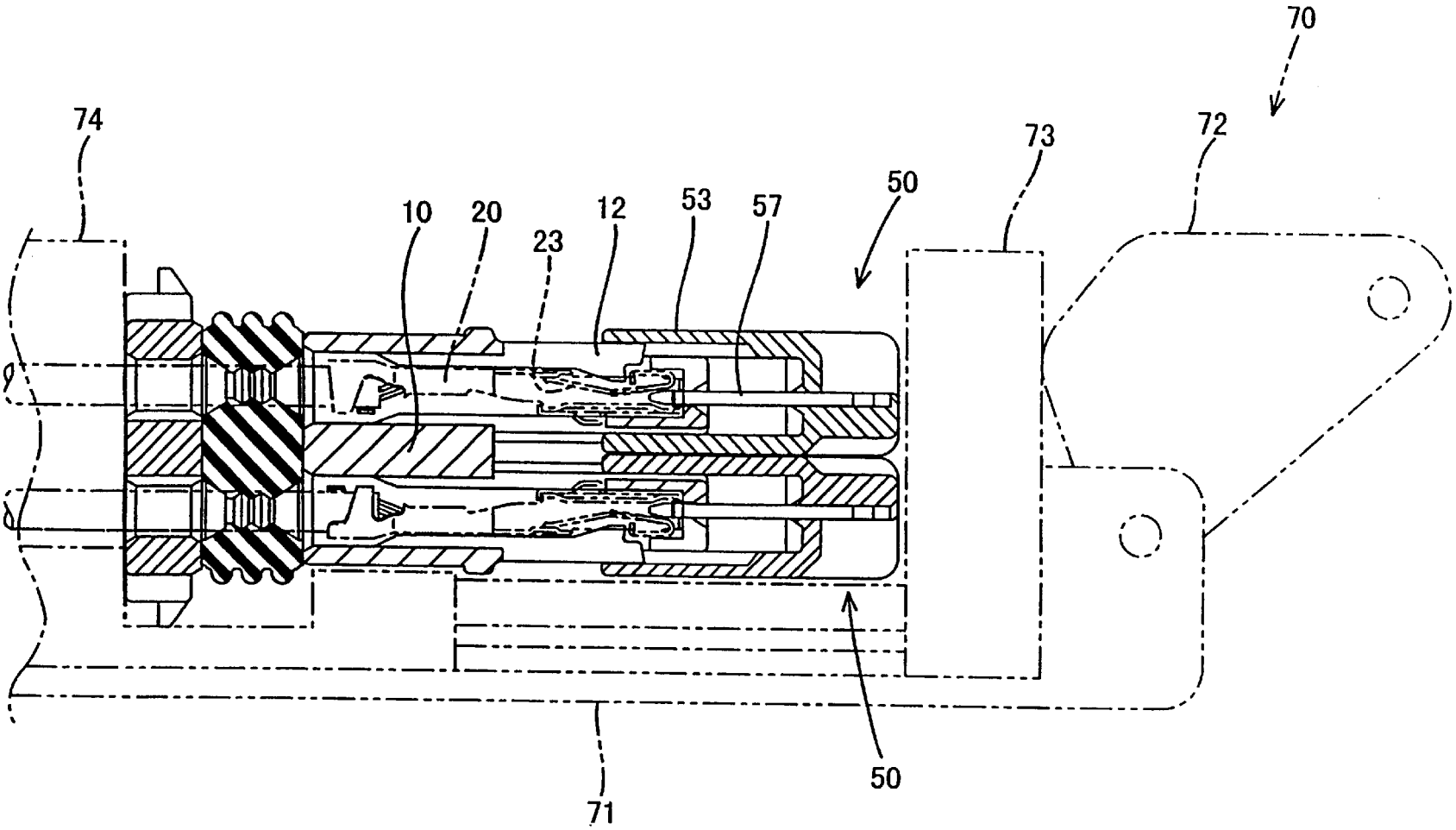
FIG. 7 is the same sectional view as FIG. 6 with bus bar units in partially installed positions and the connector set on an assembly jig.
Figure 8:
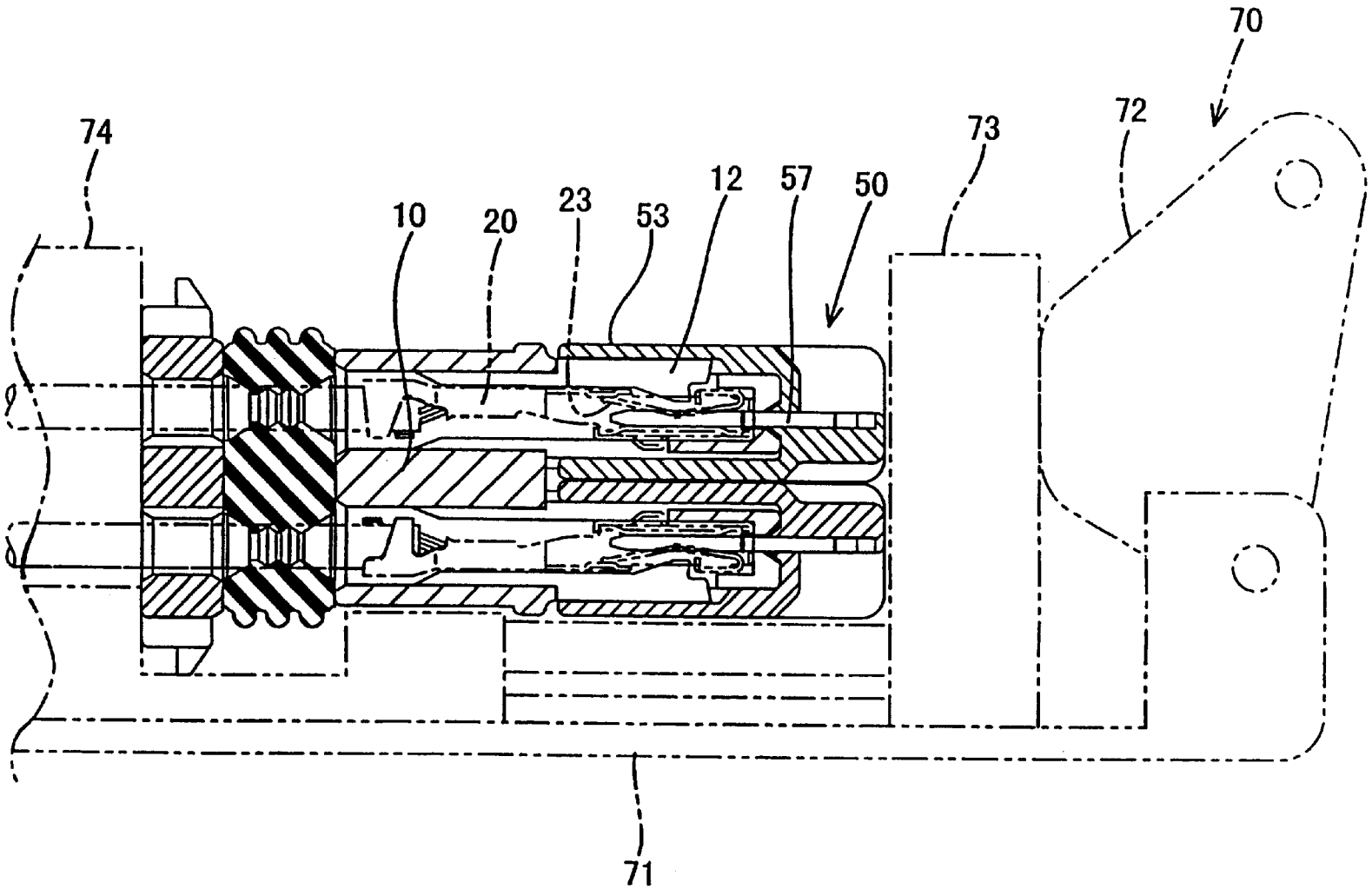
FIG. 8 is the same sectional view as FIG. 7 but with both bus bar units moved to fully installed positions by the assembly jig.
Figure 9:
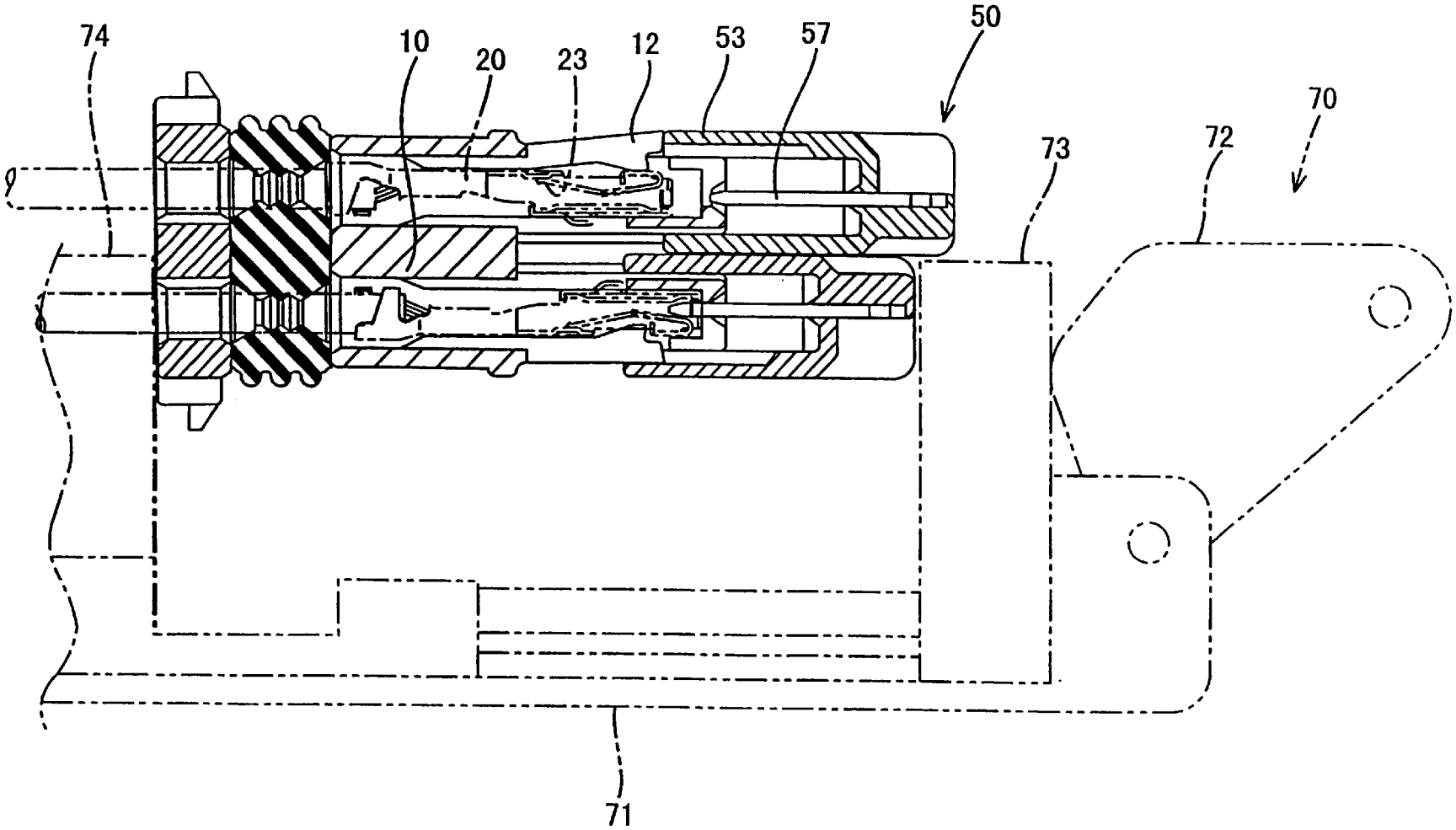
FIG. 9 is the same section view as FIG. 6, but with the upper bus bar unit prevented from arriving at its partially inserted position.

During assembly of the connector, an assembling jig 70 is used as shown in FIGS. 7–9. The assembling jig 70 has a function of installing the bus bar units 50 on the housing 10 and detecting the state of insertion of the terminals 20. As shown in FIGS. 7–9, the assembling jig 70 includes a lever 72 which is supported at the right end of a substrate 71 and can be pivoted between a waiting state shown in FIGS. 7 and 9 and an assembling state shown in FIG. 8. The assembling jig 70 also includes a pressing member 73 which is moved leftward in FIGS. 7–9 in correspondence with a pivotal motion (counterclockwise in FIGS. 7–9) of the lever 72 by a camming action of the lever 72. The assembling jig 70 also has a stationary positioning member 74 located leftward in FIGS. 7–9 from the pressing member 73. A return spring (not shown) biases the lever 72 and the pressing member 73 to the waiting position. The connector is placed between the pressing member 73 (located at the waiting position) and the positioning member 74, with the bus bar units 50 set at the temporary locking position.

The distance between the pressing member 73 in the waiting position and the positioning member 74 is equal to or a little longer than the distance between the front ends of the bus bar units 50 when the bus bar units 50 are at the temporary locking position and the rear end of the housing 10. Therefore, the connector cannot be set in the jig 70 if either bus bar unit 50 has not reached the temporary locking position. This is because the bus bar unit 50 interferes with the upper surface of the pressing member 73.

When the lever 72 is shifted from the waiting state to the assembling state after the connector has been set in the jig 70, the pressing member 73 moves leftward and presses the bus bar units 50 from the temporary locking position to the normal assembling position. During the movement of the bus bar units 50, the connection pieces 57 of the bus bar units 50 contact the resilient contact pieces 23. Consequently, the terminals 20 are connected to each other.

An assembly procedure is, for example, as follows. Initially, the sealing member 30 is sandwiched between the seal holder 40 and the housing 10. At this time, a projection (not shown) formed on the housing 10 is passed through the sealing member 30 and the tip of the projection is locked to the seal holder 40. This locks the seal member 30 to the housing 10, and removal of the seal holder 40 is prevented. Then, the terminals 20 are inserted through the openings 41 and the holes 31 into the cavities 11.

Thereafter, the bus bar unit 50 is installed at the temporary locking position on the housing 10, and the bus bar unit 50 is placed on the assembling jig 70. Then, by operating the lever 72 of the assembling jig 70, the bus bar units 50 are pressed to the fully installed position from the temporary locking position. As a result, the terminals 20 are connected in a predetermined pattern. When the bus bar unit or units 50 are in the fully installed position, the connector is removed from the assembling jig 70. Finally, the cap 60 is installed on the housing 10 in such a manner that the cap 60 covers the housing 10 and the bus bar units 50.

The lip portion 34 formed on the periphery of the sealing member 30 prevents water from penetrating into the cap 60 between the inner periphery of the cap 60 and the periphery of the sealing member 30. Further, the lip portion of the sealing hole 31 contacts the periphery of the wire 25 closely, the inner periphery of the fit-in hole 32 contacts the periphery of the holding projection 14, and the inner periphery of the fit-in hole 33 contacts the periphery of the deformation prevention projection 15. Therefore, water can be prevented from penetrating into the sealing member 30 from outside.

On installation of the bus bar unit 50 on the housing 10, when all the terminals 20 are fully inserted into their respective cavities 1, each locking lance 12 is undeformed so that its outer surface is flush with the outer surface of the housing 10. Accordingly, when the cylindrical portion 53 slides over the outer surface of the housing 10 during bus bar unit-installation, the cylindrical portion 53 does not interfere with the locking lances 12. Thus, each bus bar unit 50 can be securely installed to the temporary locking position of the housing 10. When the bus bar units 50 have been installed on the housing 10 in the temporary locking position, the cylindrical portion 53 faces the locking lances 12 in such a manner that the inner surface of the cylindrical portion 53 presses downward on the outer surfaces of the locking lances 12. Thus, the locking lances 12 are prevented from being elastically displaced in a direction which would move them away from the terminals 20 (see the lower bus bar unit of FIG. 6).

On the other hand, if there are any terminals 20 inserted into the cavity 11 in an incompletely inserted state, the locking lances 12 are elastically displaced outward and project outward from the outer surface of the housing 10. During the installation of the bus bar unit 50 on the housing 10, the front end of the cylindrical portion 53 then collides with the front end of the locking lances 12 (see upper bus bar unit of FIG. 6). As a result, the installation operator notices that the installation resistance is suddenly increased. In this manner, the operator can detect that a terminal 20 is in an incompletely inserted state.

The operator can then suspend the installation of the bus bar unit 50 on the housing 10 when the cylindrical portion 53 has collided with the locking lances 12 and resumes the installation after inserting the terminal 20 into the normal position of the cavity 11. If the operator does not feel an increase in the installation resistance, the operation proceeds to use the assembling jig 70. If the operator feels the installation resistance but forgets to re-insert the terminals 20, the operator may continue with the installation despite feeling the installation resistance. In this case, the connector cannot be set on the assembling jig 70. This alerts the operator to the fact that the bus bar unit 50 has not arrived at the temporary locking position and that one or more of the terminals 20 may have been incompletely inserted. Also, the connector cannot be set on the assembling jig 70 if the bus bar unit 50 has not reached the temporary locking position, even though all the terminals may have been inserted correctly. As is apparent from the foregoing description, if the connector cannot be set on the assembling jig 70, incorrect assembly can be corrected by checking the installation position of the bus bar unit 50 and the inserted states of the terminals 20.

As described above, during installation of the bus bar units 50 on the housing 10, the bus bar units 50 are not subjected to an installation resistance caused by contact between the connection pieces 57 of the bus bar unit 50 and the terminal fittings 20. After each bus bar unit 50 passes the temporary locking position, the connection pieces 57 start to contact the terminals 20. Accordingly, it is possible to discriminate between installation resistance on the bus bar unit 50 due to the collision of the locking lance 12 and the bus bar units 50, and installation resistance that is caused by collision between the terminals 20 and the tab pieces 57. In this manner, it is possible to reliably detect the state of insertion of the terminals 20.

If incomplete insertion of any of the terminals is noticed and it is still attempted to set the connector in the assembling jig 70, the bus bar unit 50 will be at the position of collision between the locking lance 12 the bus bar unit 50. Thus, it is impossible to set the connector in the assembling jig 70. In this manner, it is detected that one or more of the terminals are incompletely inserted. That is, a mechanism is provided for detecting the incomplete insertion of a terminal 20 both during the process of installing the bus bar unit 50 on the housing 10 and during the operation of setting the connector on the assembling jig 70. Thus, the incomplete insertion of the terminal 20 can be reliably detected.

The present invention is not limited to the embodiments described, but may be varied, for example, as described below.

(1) In the above description, a connector of waterproof type has been described. However, the present invention is also applicable to a connector of non-waterproof type.

(2) In the above description, incomplete insertion of the terminal is detectable during installation of the bus bar unit on the housing and during setting of the connector on the assembling jig. However, according to the present invention, it is possible to detect incomplete insertion of the terminal during installation of the bus bar unit on the housing without using an assembling jig.

What is claimed is:

1. A connector comprising:

a housing having a peripheral surface, a plurality of cavities, a plurality of resiliently deformable locking members, and a plurality of terminals, each of said terminals being inserted in the respective said cavity and having (a) a partially inserted position in which said terminal bears on a respective one of said locking members to deform said locking members so that said locking members are elevated with respect to said peripheral surface, and (b) a fully inserted position in which said locking members snap-fit to said terminal thereby locking said terminals in said cavities;

a bus bar holder having a sleeve and a plurality of bus bar tab pieces which are accommodated in said sleeve, said sleeve being push-fitted over said peripheral surface via a partially installed position, at which said tab pieces do not contact said terminals, to a fully installed position, at which said tab pieces contact said terminals, whereby in said fully installed position said bus bar holder is installed to said housing with said terminals electrically connected to each other; and a detent that detains said bus bar holder at said partially installed position, wherein each of said locking members is adapted so that when said terminal is in said partially inserted position with the respective one of said locking members elevated with respect to said peripheral surface and an attempt is made to push-fit said sleeve to said partially installed position, said sleeve bears on said locking member to prevent said sleeve from arriving at said partially installed position.

2. A connector according to claim 1, wherein said detent comprises an elongate recess aligned with a push-fit direction of said sleeve and terminated at one end by an end member, and first and second projections which, on push-fitting, are displaced relative to said recess, whereby in said partially installed position of said sleeve said end member is held between said first and second projections so that said second projection is received in said recess, and in said fully installed position of said sleeve both said first and second projections are received in said recess.

3. A connector according to claim 2, wherein said recess is formed in said sleeve and said first and second projections are formed on said housing facing said sleeve.

4. A connector according to claim 3, wherein said end member comprises a leading edge portion of said sleeve.

5. A connector according to claim 1, wherein said connector has two of said detents at opposite sides of said connector.

6. An assembly jig used for a connector of claim 1 and for assembling the connector by push-fitting the sleeve of the connector from said partially installed position to said fully installed position, the jig being sized so that when the sleeve of the connector is prevented from arriving at said partially installed position the connector is prevented from being set on the jig, whereas when the sleeve of the connector is at said partially installed position the connector is settable on the jig.

* * * * *